US005195713A

United States Patent [19]

Van Dore et al.

[11] Patent Number: 5,195,713

[45] Date of Patent: Mar. 23, 1993

[54] PRESENTATION RAIL ASSEMBLY

[75] Inventors: Quentin R. Van Dore; Mitchell Bakker, both of Grand Rapids; Nelson Chapman, Hastings, all of Mich.

[73] Assignee: Nucraft Furniture Company, Comstock Park, Mich.

[21] Appl. No.: 732,594

[22] Filed: Jul. 19, 1991

[51] Int. Cl.[5] ..... A47B 47/00

[52] U.S. Cl. ..... 248/441.1; 248/460; 248/345.1; 248/221.3; 248/235

[58] Field of Search ..... 248/441.1, 447.1, 447.2, 248/453, 220.2, 221.3, 222.2, 345.1, 460, 235; 52/732, 731, 717; 256/59

[56] References Cited

U.S. PATENT DOCUMENTS

| | | | |
|---|---|---|---|
| 2,291,966 | 8/1942 | Joseph | 248/298 X |
| 2,346,630 | 4/1944 | Wagner | 52/717.1 X |
| 3,335,429 | 8/1967 | Arp | 52/717.1 X |
| 4,311,295 | 1/1982 | Jamar, Jr. | 248/221.3 |
| 4,352,478 | 10/1982 | Loew | 248/221.3 |

FOREIGN PATENT DOCUMENTS

| | | | |
|---|---|---|---|
| 2300290 | 2/1975 | France | 248/221.3 |
| 82873 | 4/1956 | Netherlands | 52/731 |

*Primary Examiner*—Alvin C. Chin-Sue
*Attorney, Agent, or Firm*—Waters & Morse

[57] ABSTRACT

A presentation rail assembly is secured to a wall to provide a surface for supporting items in a near-vertical position. The assembly includes a lower rail element secured to the wall, and an upper rail element with preferably a snap-in interengagement with the lower element concealing the wall fastenings. A facing strip extends along the front of the upper element, and provides an abutment confining the lower edges of supported items. Fastenings securing the facing strip to the upper rail element are entered from the rear, when the upper rail element is separtated from the assembly.

13 Claims, 2 Drawing Sheets

PRESENTATION RAIL ASSEMBLY

BACKGROUND OF THE INVENTION

Presentation rails are commonly installed on walls and other vertical surfaces to support charts, printed material, and graphic displays. These items rest on the rails, and lean back against the wall for near-vertical presentation for best visibility. The better of these rail systems have concealed fastenings, and should be easily installed and removed by semi-skilled workmen. Present emphasis on coordinated decor makes it desirable to have the front edge of the rail match with the edges of tables or shelves as to color and configuration.

These characteristics are difficult to incorporate into one rail system, particularly when strength and cost are considered. The present invention is directed at this objective.

SUMMARY OF THE INVENTION

A preferably three-piece assembly provides a lower rail element to be secured to a wall, and an upper rail element having a snap-in relationship with the lower element. A selected facing strip is secured with concealed fastenings to the front of the upper rail element, which itself conceals the fastenings holding the lower rail element to the wall. The rail elements are both preferably extruded or rolled sections. The facing strip extends above a supporting floor on the upper rail element to provide an abutment extending along the rail system to confine the lower edges of displayed items. The rail elements have a positive interengagement for the transfer of weight and accidental forces.

FIGS. *7a–g* present illustrations of various decorative configurations for the facing strip of the assembly.

DESCRIPTION OF THE PREFERRED EMBODIMENTS

Figure 1:
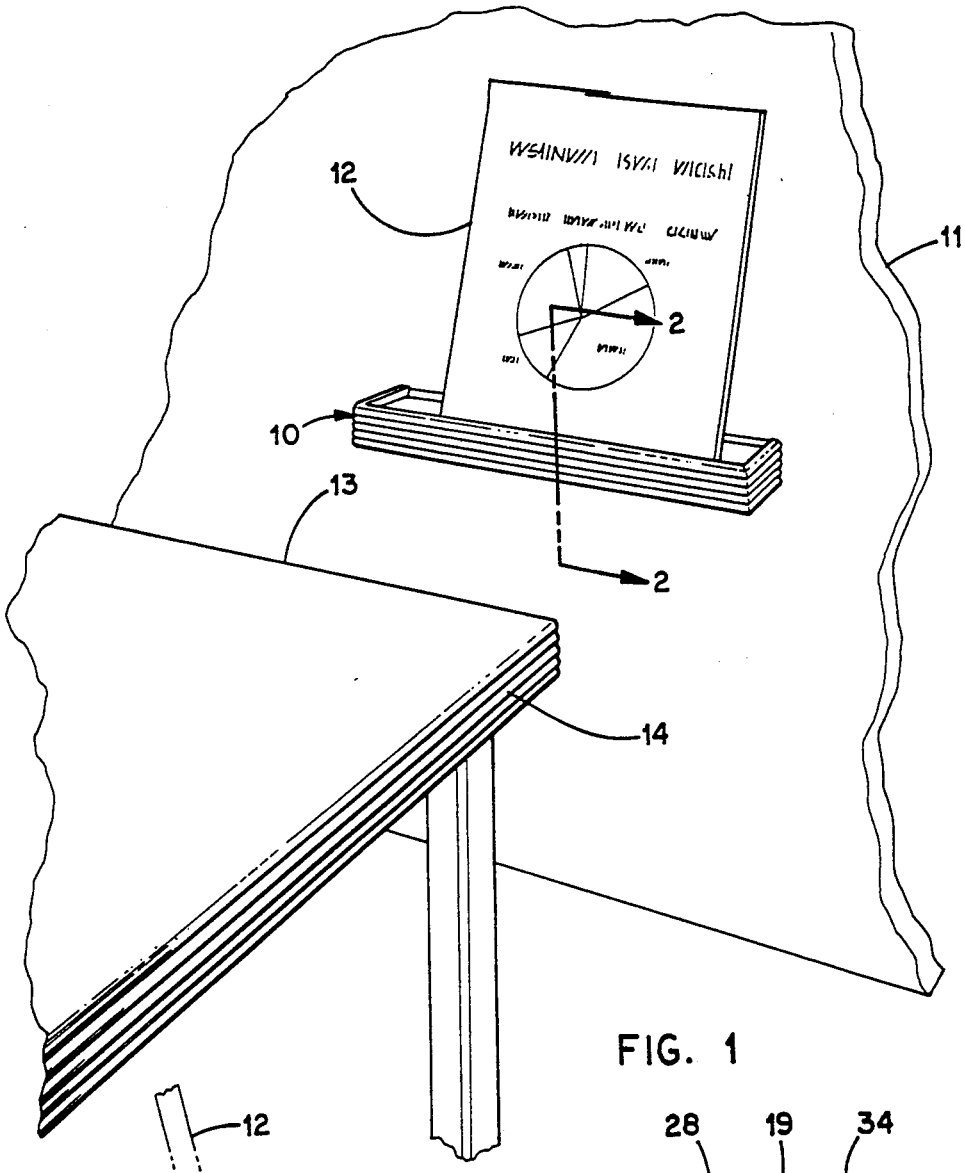
FIG. 1 is a fragmentary perspective view of a typical installation of a presentation rail on a wall, showing the decorative relationship between the rail and the edge of an adjacent table.

Referring to FIG. 1, the presentation rail assembly 10 is shown mounted on the wall 11 to support an item as indicated at 12 in near-vertical position for viewing within the room. The table 13 in the same room has an edge configuration indicated at 14 matching with the front of the rail assembly 10.

Figure 2:
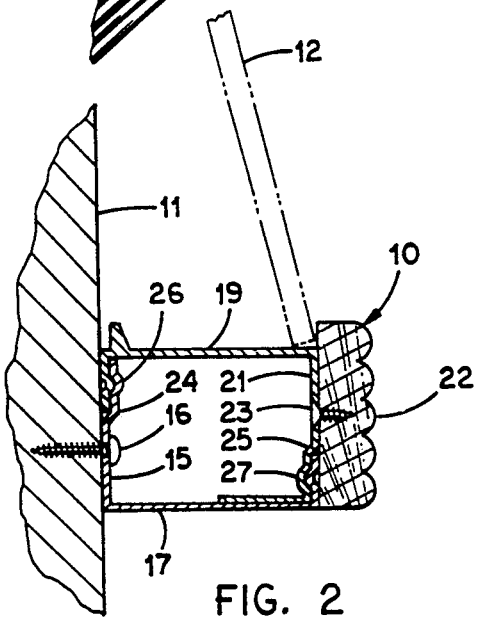
FIG 2 is a section on an enlarged scale on the plane 2—2 of FIG. 1.
Figure 3:
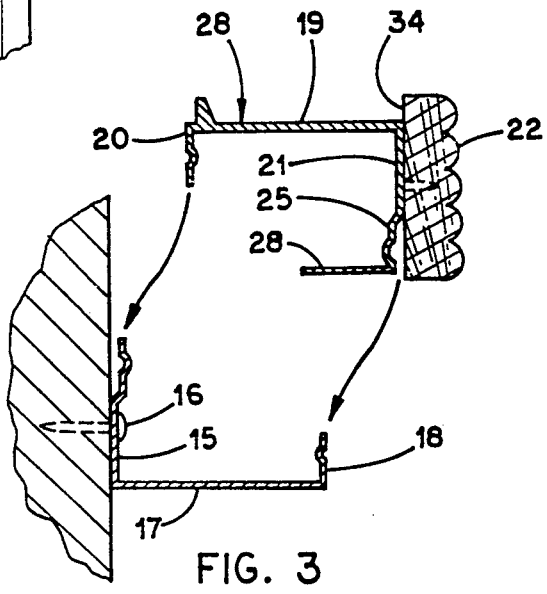
FIG. 3 is an exploded view showing the components of FIG. 2 separated as they might be during installation.
Figure 4:
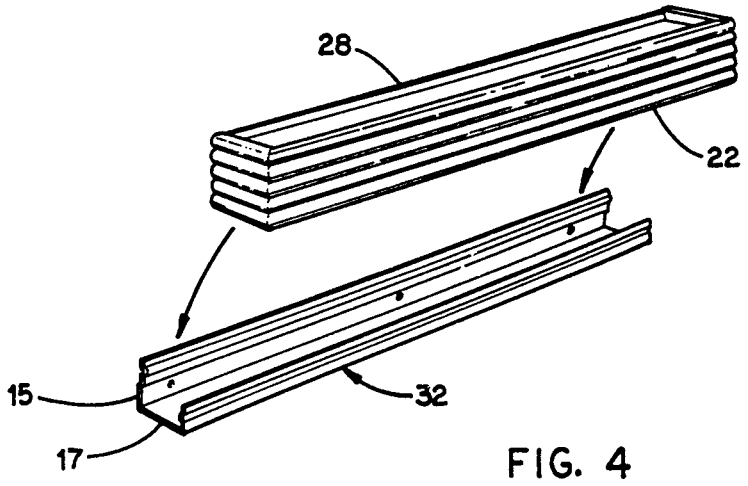
FIG. 4 is an exploded view showing the relationship between the components illustrated in FIG. 3, in frontal perspective.

Referring to FIG. 2, the lower rail element has a mounting flange 15 secured to the wall 11 by the screws 16. A shelf 17 extends horizontally from the flange 15, to the upwardly-turned flange 18 (refer to FIG. 3). An upper rail element has a floor 19 for supporting the displayed material, and a downwardly-extending flange 20 at the inner extremity of the floor 19. At the outer extremity, the upper rail element has a frontal flange 21 to which the facing strip 22 is secured with screws as shown at 23 in FIG. 2. The mounting flange 15 has an offset 24 that receives the downwardly-extending flange 20 in the space between the flange 15 and the wall 11. The frontal flange 21 has a similar offset 25 providing a space between the flange 21 and the facing strip 22 for receiving the flange 18. The flange 20 and the offset portion 24 have interengaged ridges and grooves as shown at 26 providing a snap-in engagement between these components as the upper rail element is forced downwardly into engagement with the lower rail element. Similarly, the flange 18 and the offset portion 25 have interengaged ridges and grooves as shown at 27 to provide the same snap-in arrangement. The lower extremity of the frontal flange 21 is provided with the bearing ledge 28 normally resting on the shelf 17 as shown in FIG. 2.

Figure 5:
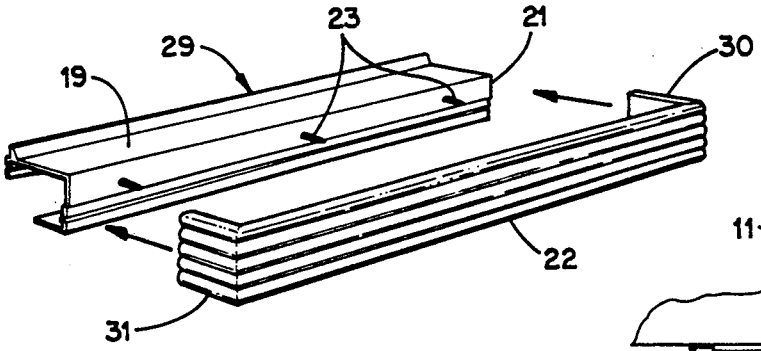
FIG. 5 is an exploded view showing the relationship between the facing strip and the upper rail element.
Figure 6:
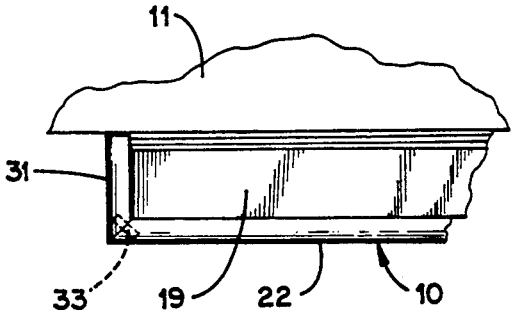
FIG. 6 is a fragmentary top view of the rail assembly.
Figure 7A:
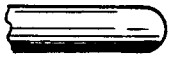
Figure 7B:
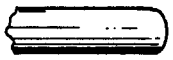
Figure 7C:
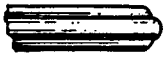
Figure 7D:
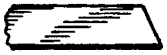
Figure 7E:
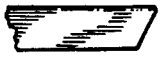
Figure 7F:
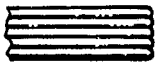
Figure 7G:
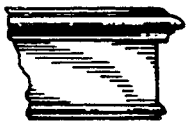

FIGS. *7a–g* illustrate various possible configurations for the frontal strip 22. Ideally, these configurations should match with similar configurations on the furniture and shelving that may also be present in the room, as indicated at 14 in FIG. 1. In FIG. 5, the upper rail element 29 is shown provided with holes receiving the screws 23 for engagement with the facing strip 22 from the rear, so that these fastenings will be concealed from view within the room. Preferably, the frontal strip 22 should have end sections as shown at 30 and 31 positioned at right angles to the front of the assembly so that the ends of the upper and lower rail sections 29 and 32 are concealed from view. The end sections 30 and 31 can be constructed in the manner of picture frames, with the corners mitered as shown in FIG. 6, with diagonal dowels or special clips as shown at 33 for strengthening this joint. Regardless of the selected configuration for the facing strip 22, it should extend somewhat above the floor 19 of the upper rail element, as shown at 34 in FIG. 3 to provide an abutment preventing the displayed items 12 from slipping outwardly off the shelf 19.

We claim:

1. A presentation rail assembly for supporting display materials on a wall comprising:

a lower rail element providing a vertical mounting flange attached to a wall by fasteners extending through openings in the mounting flange, the lower rail element further including a horizontal shelf extending outwardly from a lower portion of said mounting flange;

an elongated upper rail element that completely covers the lower rail element and the fasteners that attach it to the wall, the upper rail element having an inner portion thereof engageable with the upper extremity of said mounting flange so as to prevent the inner portion of the upper rail element from downward or outward movement with respect to the lower rail element, the upper rail element also having a floor extending outwardly from the inner portion above said shelf to an outer extremity which is a sufficient distance away from the inner portion that the floor can serve as a support for display materials in an inclined position, the upper rail element further having a frontal portion extending downward from an outer portion of said floor and engageable with said shelf so as to provide vertical support for the outer portion of the floor, the frontal portion including a frontal flange extending downwardly from the floor and a facing strip attached to the frontal flange and covering the front of the upper and lower elements, the frontal portion further including;

abutment means at the outer extremity of said floor and extending above said floor to restrain display materials from sliding off the front of the rail assembly.

2. An assembly as defined in claim 1, wherein said mounting flange has an outwardly offset portion at an upper extremity thereof, and the inner portion of said upper rail element includes a downwardly-extending flange receivable behind said offset portion such that the flange fits closely between the offset portion and the wall when the mounting bracket is mounted in a wall.

3. An assembly as defined in claim 2, wherein said offset portion and downwardly-extending flange have interengageable snap-in ridges and grooves, respectively, which are urged into resilient engagement by the wall when the mounting bracket is mounted on a wall.

4. An assembly as defined in claim 1, wherein said shelf has an upwardly-extending flange at an outer extremity thereof engageable with the lower extremity of said frontal flange so as to restrain outward movement of said lower extremity with respect to the lower rail element.

5. An assembly as defined in claim 4, wherein said frontal flange and upwardly-extending flange have interengageable snap-in ridges and grooves, respectively.

6. An assembly as defined in claim 5, wherein said frontal flange has a horizontal bearing ledge extending inward from the lower extremity of said frontal flange, and receivable on the top surface of said shelf.

7. An assembly as defined in claim 4, wherein said frontal flange has an inwardly offset portion at the lower extremity thereof, and said upwardly-extending flange is receivable in front of said frontal flange offset portion.

8. An assembly as defined in claim 7, said upwardly-extending flange is receivable between said frontal flange offset portion and facing strip.

9. An assembly as defined in claim 1, wherein the facing strip is secured to the outer surface of said frontal flange by fastening means traversing said frontal flange and extending into said facing strip, said facing strip extending above said floor to provide said abutment means.

10. An assembly as defined in claim 9, wherein the facing strip comprises a frontal strip mounted on the frontal flange and end sections extending inwardly from ends of the frontal strip so as to enclose and cover opposite ends of the upper rail floor.

11. An assembly as defined in claim 10, wherein the end sections also abut opposite ends of the lower rail element and hold the upper and lower rail elements in alignment.

12. An assembly as defined in claim 10, wherein the rail elements are metal members and the facing strip is a replaceable decorative member selectable to match the decor of selected room furniture.

13. A presentation rail for supporting display materials on a wall, the presentation rail supporting a lower end of the display materials at a position spaced away from the plane of the wall, such that the upper end of the display materials lean back against the wall at a slightly inclined angle, the presentation rail comprising:

an elongated lower rail element including an upwardly extending mounting flange that is fastenable to the wall by releasable fasteners, the mounting flange having an offset portion at an upper end thereof that is spaced outwardly from the plane of the mounting flange, a shelf extending outwardly from a lower portion of the mounting flange, an upwardly turned flange extending from an outer end of the shelf;

an elongated upper rail element that fits on and covers the length of the lower rail element, the upper rail element being retained in position on the wall by the lower rail element, the upper rail element including a horizontal floor that is adapted to extend outwardly from the wall at the top of the lower rail element, a flange extending downwardly from an inner edge of the floor so as to fit between the wall and the mounting flange offset portion when the bracket is mounted on a wall, the offset portion and flange having mating snap fit means for resiliently holding the upper rail element in engagement with the mounting flange after the upper rail element has been fully inserted downwardly on the lower rail element with the flange of the shelf extending downwardly between the wall and the offset portion of the lower rail element, a frontal flange extending downwardly from an outer edge of the floor, the frontal flange having an inwardly offset portion at a lower end thereof, the offset portion resiliently engaging and fitting inside the upwardly turned flange of the lower rail element; and a decorative facing strip having a front portion attached to the frontal flange of the upper rail element and extending the full width and height of the upper rail element so as to completely cover the frontal flange of the upper rail element and the outer edge of the floor, the facing strip including rearwardly extending end sections at ends of the front portion that extend rearwardly to the wall to cover the ends of the presentation rail and enclose the ends of the upper rail element, the facing strip extending upwardly from the plane of the floor such that the facing strip forms an abutment extending along the outer edge of the floor, the abutment restraining display materials resting on the floor from sliding off the outer edge of the presentation rail.

* * * * *